US006565943B1

(12) United States Patent
Kondo et al.

(10) Patent No.: US 6,565,943 B1
(45) Date of Patent: May 20, 2003

(54) SURFACE FASTENER FORMED OF FIBERS

(75) Inventors: Yoichi Kondo, Toyama-ken (JP); Masashi Doi, Toyama-ken (JP); Mitsutoshi Ishihara, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/373,876

(22) Filed: Aug. 12, 1999

(30) Foreign Application Priority Data

Aug. 31, 1998 (JP) ..... 10-245768

(51) Int. Cl.[7] ..... A44B 18/00; B32B 3/06

(52) U.S. Cl. ..... 428/100; 428/223; 24/442; 24/444; 24/445; 24/446

(58) Field of Search ..... 428/100, 223; 24/442, 444, 445, 446

(56) References Cited

U.S. PATENT DOCUMENTS

| | | | | |
|---|---|---|---|---|
| 4,338,800 A | | 7/1982 | Matsuda | 66/194 |
| 5,373,712 A | * | 12/1994 | Yamamoto et al. | 66/195 |
| 5,669,120 A | | 9/1997 | Wessels et al. | 24/446 |
| 6,202,264 B1 | * | 3/2001 | Ishihara | 24/445 |

FOREIGN PATENT DOCUMENTS

| | | | |
|---|---|---|---|
| EP | 0 619 085 | | 10/1994 |
| EP | 0 682 888 | | 11/1995 |
| EP | 0 893 114 | | 1/1999 |
| JP | 47-9390 | * | 3/1972 |

* cited by examiner

*Primary Examiner*—Terrel Morris
*Assistant Examiner*—John J. Guarriello
(74) *Attorney, Agent, or Firm*—Finnegan, Henderson, Farabow, Garrett & Dunner, L.L.P.

(57) ABSTRACT

The present invention provides a surface fastener wherein necessary engaging strength is maintained for a long term, the surface fastener is flexible and has a favorable touch without prickly feeling even when male engaging elements formed of fibers are employed, and strange peeling noise is not generated. The surface fastener includes at least a large number of male engaging elements planted on a foundation cloth which is a woven or knitted fabric or a non-woven fabric and is formed of fibers, the surface fastener being engaged with and disengaged from a mating surface fastener. The foundation cloth has groups each including a plurality of hook-shaped engaging elements having a small diameter and standing up from a common position of a face of the foundation cloth with respective base end portions of the hook-shaped engaging elements being in adjacent to each other, and the base end portions of the plurality of hook-shaped engaging elements constituting the groups are bonded and integrated by a part of synthetic resin as a backing agent which penetrates the woven or knitted foundation cloth.

6 Claims, 6 Drawing Sheets

SURFACE FASTENER FORMED OF FIBERS

BACKGROUND OF THE INVENTION

1. Field of the Invention

The present invention relates to a surface fastener formed of fibers wherein necessary engaging strength is ensured, the surface fastener is flexible and is excellent in touch, and peeling of the surface fastener can be carried out smoothly.

2. Description of the Related Art

A conventionally and widely known typical surface fastener formed of fibers has female or male engaging elements obtained by weaving/knitting at the time of weaving/knitting of a foundation cloth. The female engaging elements are normally in a shape of loops formed of multifilament and the male engaging elements are in a hook shape or a mushroom shape.

Normally, the male engaging elements of the surface fastener are formed of a monofilament having a large diameter, and the hook-shaped or mushroom-shaped male engaging elements of the male surface fastener are engaged with and disengaged from the loops as a large number of female engaging elements of the female surface fastener. Therefore, in order to ensure necessary engaging strength with which the male engaging elements are engaged with the mating loops by using a single monofilament for the male engaging element, the monofilament is required to be rigid to some degree and to have a large diameter. As a result, the male surface fastener is rough and hard to the touch, and in addition, a noise is liable to be generated when the male engaging elements are disengaged from the female engaging elements.

It is known that the mushroom-shaped engaging element is superior in engaging strength to the hook-shaped engaging element and that the mushroom-shaped engaging element can be engaged with the opposite loop in every direction because an engaging head of the mushroom-shaped engaging element bulges in every direction when comparisons are made between the hook-shaped engaging element and the mushroom-shaped engaging element of the same material and with the same diameter. As a result, because the same engaging strength can be obtained even when the diameter of the mushroom-shaped engaging element is smaller than that of the hook-shaped engaging element, the mushroom-shaped engaging element is superior in flexibility to the hook-shaped engaging element when the mushroom-shaped engaging element has the same engaging strength as the hook-shaped engaging element.

However, because the engaging head itself of the mushroom-shaped engaging element is not elastically deformed, a surface of the surface fastener is prickly to the touch. Furthermore, because the mushroom-shaped engaging element is engaged with the mating loop in such a manner that the loop is wound around a neck portion of the engaging head of the mushroom-shaped engaging element, i.e., the mushroom-shaped engaging element is hung by its neck portion, the neck portion is liable to be cut in engagement and disengagement of the surface fastener or the mating loop is cut, and thus, the surface fastener with the mushroom-shaped engaging elements lacks durability.

In such present circumstances, because the surface fastener is frequently applied to a portion of a diaper, sportswear, underwear, or the like, the portion being in direct contact with skin, a surface fastener formed of fibers which is flexible, excellent in the touch, and has necessary engaging strength, and wherein little noise is generated in peeling is demanded. In order to satisfy such a demand, a male surface fastener which is flexible and excellent in the touch and has necessary engaging strength is disclosed in Japanese Patent Publication No. 47-9390, for example.

According to the Japanese Patent Publication No. 47-9390, twisting of 200 T/m or more is applied to three to ten filaments having diameters of 50 to 200 D so as to form a pile yarn. The pile yarns are planted into a substrate to form a substrate sheet having on a surface thereof a large number of loops. After heating the substrate sheet to fix forms of the loops and the twist thereof, a top portion or a leg portion of each the loop is cut. The cut loops are opened to produce a surface fastener having a plurality of hooks with a small diameter which stand from a position of the substrate. With the surface fastener having the above structure, engaging strength of each the hook can be decreased to facilitate peeling, generation of a strange peeling noise can be diminished, and an engaging rate of the hooks with the loops can be increased to increase the total engaging strength.

In the surface fastener disclosed in the above Japanese Patent Publication No. 47-9390, however, because a twisted form remains certainly in each the fiber constituting the hook as shown in the drawings, a form of the engaging head of the hook is not stable, and in addition, uniform engaging strength of the hooks can not be expected because of an intricate shape of the hooks. Although coming off of the hooks is prevented by applying resin finish to the substrate in case that the substrate is a cloth formed by weaving/knitting, a base end portions of the plurality of hooks standing up from one and the same position of the substrate are merely fixed in a twisted state. Therefore, although rigidity can be expected in the base end portion to some extent in the beginning of use of the surface fastener, the twist is liable to be removed as a result of repeated use. Once the twist is removed, the base end portion is separated into individual fibers. Because each the individual hook can not have necessary rigidity, the hook is easily bent when the hooks are pushed against the mating surface fastener to engage the hooks with the loops, and thus, the hook can not be engaged with the loop. As a result, a total engaging rate is reduced and the engaging strength which is required of the surface fastener is also reduced suddenly.

SUMMARY OF THE INVENTION

The present invention has been developed to solve the above problems, and specifically, it is an object of the invention to provide a surface fastener, wherein necessary engaging strength can be maintained for a long term, the surface fastener has sufficient flexibility even though male engaging elements are formed of fibers and is comfortable to the touch without a prickly feeling, and a strange peeling noise is not generated in addition.

According to a first aspect of the invention, there is provided a surface fastener formed of fibers including at least a large number of male engaging elements planted on a foundation cloth which is a woven or knitted fabric or a non-woven fabric and is formed of fibers, the surface fastener being engaged with and disengaged from a mating surface fastener, wherein the surface fastener has groups each consisted of a plurality of male engaging elements having a small diameter of wire and standing up from a common position of a face of the foundation cloth with respective base end portions of the male engaging elements being in adjacent to each other, and the base end portions of the adjacent male engaging elements are joined by a part of a backing agent which penetrates the woven or knitted foundation cloth.

In this invention, because the groups each consisted of the plurality of male engaging elements stand up from the same position of the foundation cloth formed of fibers, the plurality of male engaging elements standing up from the same position are engaged with the large number of loops on the mating female surface fastener even when the diameter of the male engaging elements is an integral submultiple of the conventional diameter. As a result, the engaging rate is improved and a desired total necessary engaging strength can be applied to the male surface fastener. Because the male engaging elements are secured and integrated by bonding by a part of the backing agent at the base end portion of the group, rigidity of the base end portion of the entire group is increased. As a result, the male engaging elements do not fall down easily in engaging the surface fasteners by pushing the male surface fastener and the mating female surface fastener against each other, thereby improving the engaging rate of the male engaging elements with the mating loops and ensuring the total engaging strength.

Preferably, each of the male engaging elements constituting the group are in a hook shape. As this type of male engaging element formed of fiber, there is a mushroom-shaped engaging element in addition to the hook-shaped engaging element. However, because a cap-shaped or a spherical engaging head which is hung by its neck portion at the time of disengagement from the mating loop is liable to be cut in case of the mushroom-shaped male engaging element, while the hook-shaped male engaging elements are less prickly to the touch and the loops can be easily disengaged from the hook-shaped male engaging elements due to elastic deformation of the hook-shaped male engaging elements as compared with the mushroom-shaped male engaging elements, the male engaging elements are preferably in the hook shape. Needless to say, the mushroom-shaped male engaging elements are not eliminated from the invention.

Further preferably, engaging heads of the plurality of hook-shaped engaging elements constituting each of the groups are orientated in different directions at an angle in a range of 0° to 90° from each other about a base end portion of the group as a center. As the engaging heads of the plurality of hook-shaped engaging elements constituting each of the groups are in many orientations, engaging rate with the mating loops in random orientations is increased and peeling force acts uniformly in many directions.

Also preferably, at least one of the respective male engaging elements constituting the group has a larger diameter than the rest of the engaging elements. With the male engaging elements constituting the group having different diameters, the engaging strength is ensured and the entire engaging face is flexible to the touch.

Still preferalby, at least one of the male engaging elements constituting the group is higher than the rest of the engaging elements. As the plurality of male engaging elements constituting the group have different heights, the male engaging elements are engaged with the loops with different heights at the same position of the mating female surface fastener, thereby increasing the total engaging strength.

Preferably, loop-shaped female engaging elements are mixed on the face of the foundation cloth. With the male and female engaging elements being mixed on the surface of the same foundation cloth, it is unnecessary to control the male and female engaging elements separately from each other and it is unnecessary to distinguish the male and female surface fasteners from each other when it is attached to a product.

DESCRIPTION OF THE PREFERRED EMBODIMENTS

Preferred embodiments of the present invention will be specifically described below by reference to the accompanying drawings.

Figure 1:
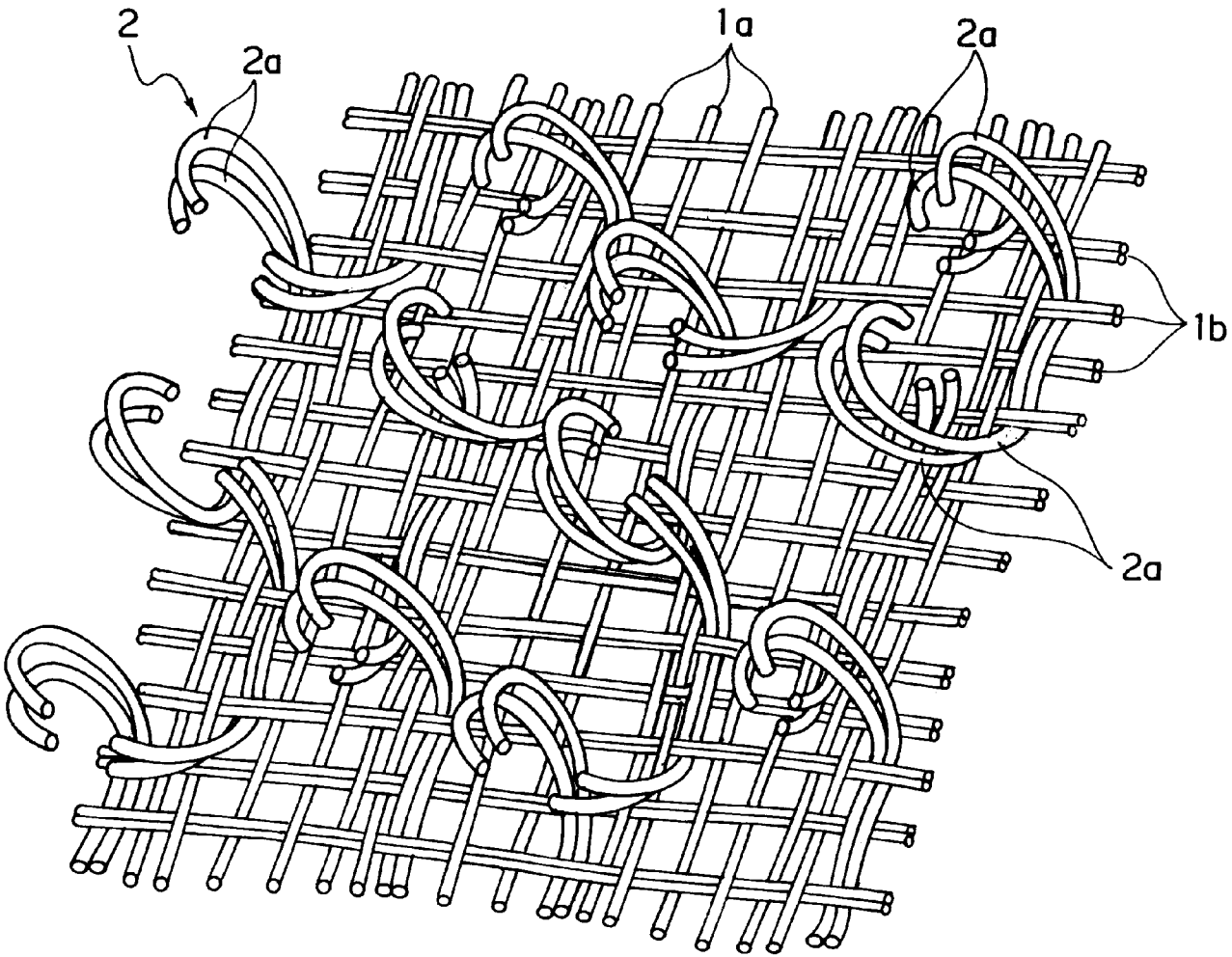
FIG. 1 is a fragmentary perspective view schematically showing a surface fastener formed of fibers according to a first embodiment of the present invention before application of back coating.
Figure 2:
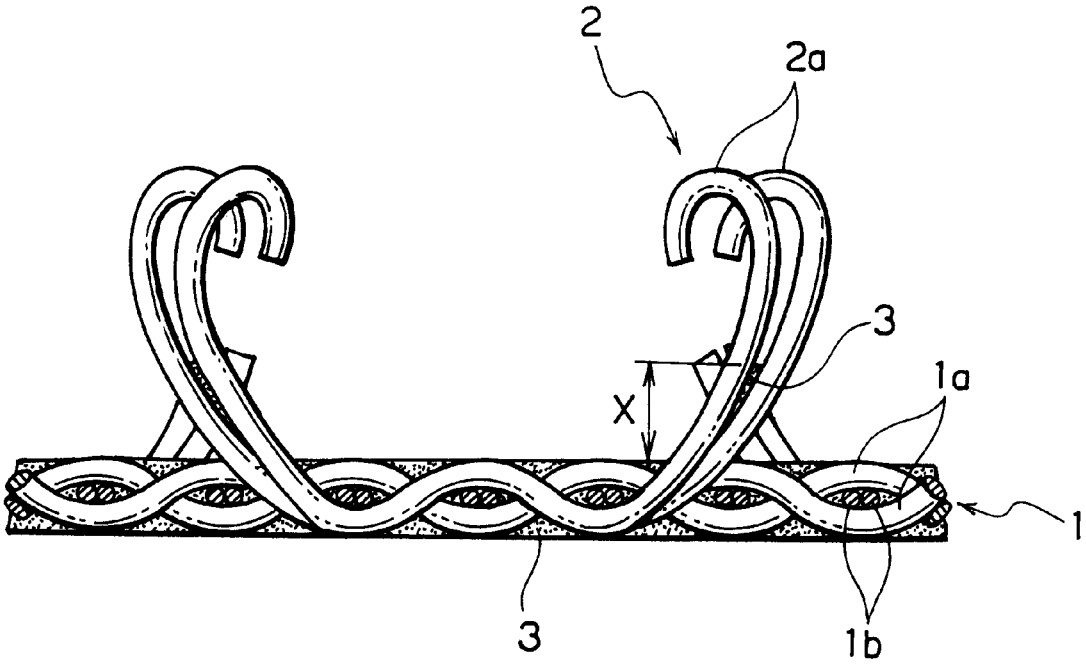
FIG. 2 is an enlarged side view of an example of engaging elements of the surface fastener of the invention.

FIG. 1 is a fragmentary perspective view of a surface fastener of the first embodiment of the invention before application of back coating. FIG. 2 is a fragmentary sectional view of the surface fastener after application of the back coating and is an enlargement focusing on engaging elements of the surface fastener.

The surface fastener according to the invention comprises a foundation cloth 1 which is formed of fibers and is a woven or knitted fabric, a non-woven fabric, or the like, a large number of hook-shaped engaging elements 2 standing up from a surface of the foundation cloth 1, and synthetic resin 3 to coat a rear face of the foundation cloth 1.

As fiber material for the foundation cloth, synthetic fiber which is made of polyamide, polyester, polypropylene, or the like and is used for this type of surface fastener formed of fibers, or natural fiber such as cotton and wool are used. For the hook-shaped engaging elements, monofilament obtained from thermoplastic synthetic resin similarly made of polyamide, polyester, polypropylene, or the like is used. As a backing agent, two-component adhesive including a combination of one of polyurethane resin and polyester resin and one of polyisocyanate hardener and epoxy hardener, a combination of acrylic resin and melamine hardener, or mixtures of them, or copolymerized nylon one-component adhesive.

Figure 3:
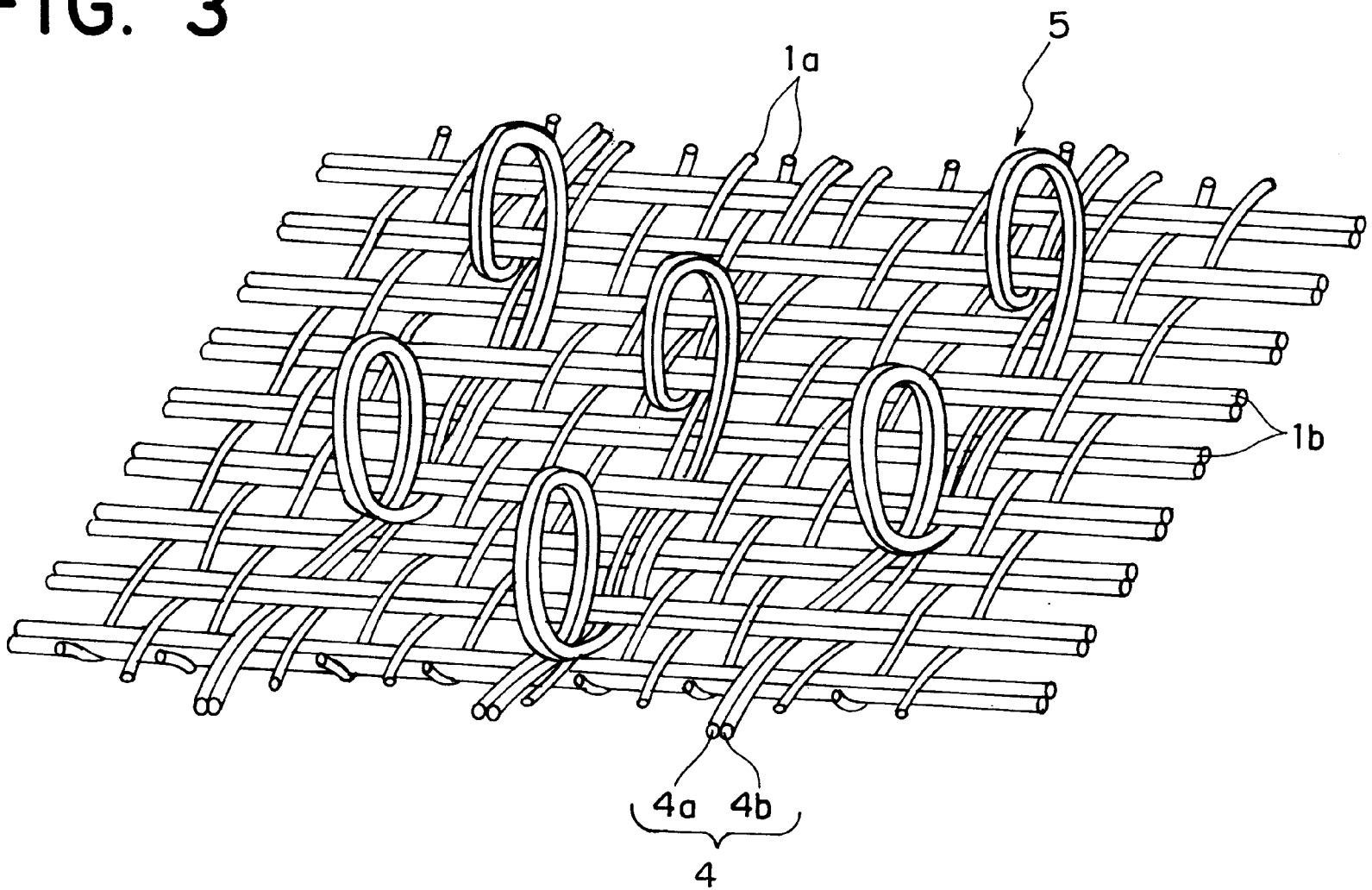
FIG. 3 is a fragmentary perspective view schematically showing a loop weaving structure before formation of hookshaped engaging elements.

One of characteristics of the invention resides in the hook-shaped engaging element 2. FIG. 3 shows an example of a loop woven fabric before formation of the hook-shaped engaging elements 2 consisted of groups of single hook-shaped engaging element 2*a* according to the present embodiment. According to this example, two monofilaments 4*a* and 4*a* are doubled and woven as a warp 4 into the foundation cloth 1 of a plain weaving structure of 1/1 while forming loops 5. After thermally setting, one of leg portions of each the loop 5 is cut to obtain the surface fastener on which two hook-shaped engaging elements 2*a,* 2*a* are formed for each the loop 5 before application of the back coating as shown in FIG. 1.

Although a number of the monofilaments constituting a warp is arbitrary as long as the number is two or more in the invention, the hook-shaped engaging element 2*a* of the invention is preferably a group of 2 to 6 monofilaments because it is necessary that a single hook-shaped engaging element 2*a* has necessary engaging strength, and 2 or 3 monofilaments can exhibit a satisfactory function. However, because a monofilament with a smaller diameter of wire is used when importance is placed on flexibility, it is preferable that 4 to 6 monofilaments which are laid together are used as the warp 4. In this case, the number of hook-shaped engaging elements 2 obtained from a single loop 5 corresponds to the number of the monofilaments used.

According to the embodiment, because the foundation cloth and the loops are woven by using a tape loom, a single yarn is used for each warp 1*a* in constituting yarns of the foundation cloth 1, but each weft 1*b* includes two doubled yarns because the weft 1*b* is double picked as shown in FIG. 1. The warps 4 for forming hooks and including two doubled monofilaments 4*a*, 4*a* are disposed at every four foundation cloth warps 1*a* of the foundation cloth 1 formed of the plain weave and woven in a weft direction while forming the loops 5. The warp 4 for forming the hooks woven along a first warp 1*a* for the foundation cloth passes under the first weft 1*b*, passes over the next weft 1*b*, passes under the third weft 1*b*, and diagonally passes over the first warp 1*a* for the foundation cloth and a fourth weft 1*b* to form a loop 5. After forming the loop 5, the warp 4 for forming the hooks passes alternately under and over the next three wefts 1*b* along the first warp 1*a* for the foundation cloth and diagonally passes over the succeeding fourth warp 1*a* for the foundation cloth and the weft 1*b* to form the next loop 5. By repeating the above operations, the loops 5 are formed in sequence in a warp direction. The loops 5 which are adjacent to each other in the weft direction are respectively formed at the wefts 1*b* which are displaced from each other by a weft in the warp direction in a zigzag manner.

An example of finenesses and yarn densities of the warp 1*a* for the foundation cloth, the weft 1*b* (two folded yarn), and warp 4 for forming the hooks and including two doubled monofilaments to be woven are as follows: 140d×559 yarns/103.5 mm for the warp 1*a* for the foundation cloth; 100 d×104 yarns/inch for the weft 1*b* (two folded yarn); 150d×264 yarns (132×2 yarns) for the warp 4 for forming the hooks. Needless to say, the invention is not limited to such values.

Normal thermal setting is applied to the loop cloth obtained as described above to fix loop forms. After the loop forms are fixed, back coating is applied to a surface (rear face) on a side of the foundation cloth 1 opposite to a side on which the loops 5 are formed to secure base ends of the loops 5 to the foundation 1. A second characteristic of the invention is that the base end portions of the loop 5 comprising the plurality of monofilaments 4*a*, 4*a* standing up from the same position are secured to and integrated with each other by utilizing a part of a backing agent used in the back coating.

In other words, when the back coating is carried out on preferable conditions, the part of the backing agent seeps through grain of the foundation cloth 1 onto the surface side on which the loops 5 are formed and penetrates between the base end portions of the loop 5 in the standing up direction of the loop 5 due to surface tension, the base end portions of the loop 5 being doubled and in contact with each other. An amount of penetration is greatly affected by viscosity of the backing agent.

For example, when two-component adhesive of polyurethane resin and polyisocyanate hardener is used as the backing agent as described above, a crosslinking reaction time of liquid itself is appropriately selected such that a penetrating property is controlled by a degree of viscosity generated by a lapse of the reaction time. Furthermore, the penetrating property is controlled by selecting an appropriate degree of viscosity by adding diluent such as toluene.

Figure 4:
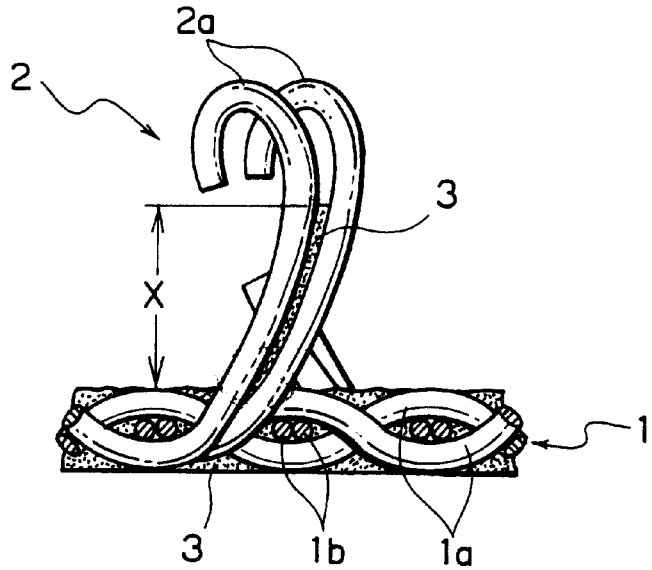
FIG. 4 is a sectional view of an example of the surface fastener of the invention, wherein a penetration height in base end portions of a plurality of engaging elements is high.

By properly controlling the diluent used for the backing agent, an amount of solvent, the crosslinking reaction time of the adhesive, and the like, a penetration height between the doubled and adjacent loops 5 can be controlled. FIG. 4 shows an example wherein a penetration height (x) of the backing agent penetrating the base end portions of the two hook-shaped engaging elements 2*a* standing up from the same position of the foundation cloth 1 is higher than that in the above first embodiment. In this manner, the penetration height (x) can be changed arbitrarily.

A portion of a leg portion of each the loop 5 of the foundation cloth 1 having loops and applied with back coating as described above is cut by a loop cutting device according to a general process to form a hook-shaped engaging element 2. When the leg portion of the loop 5 is cut by the loop cutting device, hook portions of the two loops 5 which have been bound in a doubled state with their base end portions having been secured and integrated can move freely, rotate in such directions that torsion can be released about the secured base end portions as pivots especially due to torsional stress out of stress hysteresis which has been received by the loops 5, and are oriented in different directions from each other.

Figure 5:
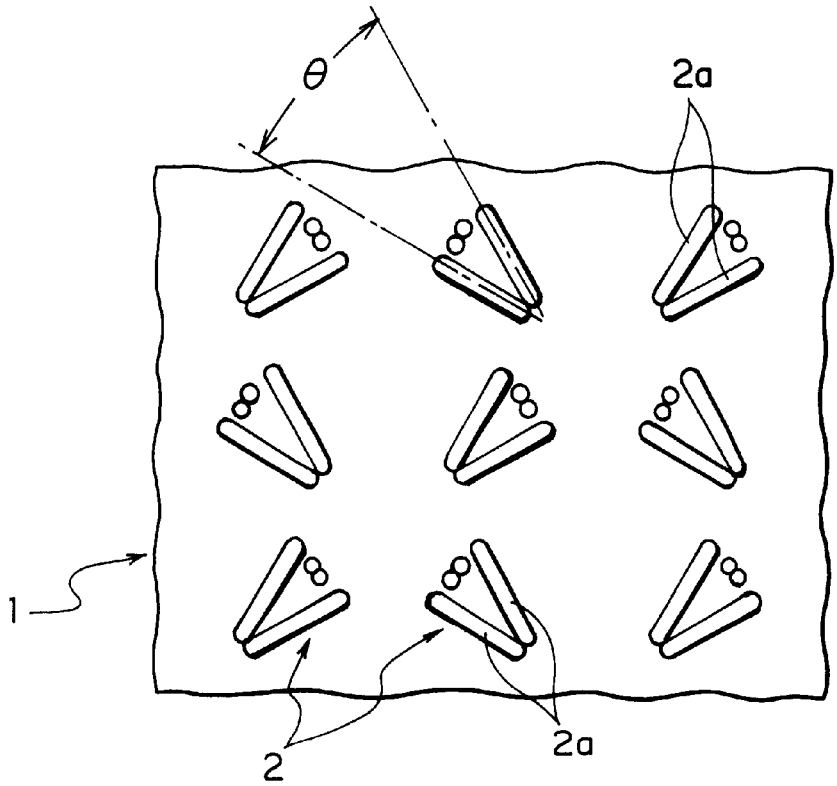
FIG. 5 is a plan view of an example of the surface fastener of the invention, wherein a plurality pairs of adjacent engaging elements are in different orientations.

In order to actively causing the rotation, the respective monofilaments 4*a* are drawn from bobbins not horizontally but vertically when the plurality of monofilaments 4*a* are supplied to the loom as being doubled or laid together, thereby applying desired twist (torsion) to each filament. This twisting is different from the active twisting applied to the loop yarn as disclosed in the above-described Japanese Patent Publication No. 47-9390. According to the twisting of the invention, a twist number is extremely small and twistings in reverse directions to each other are applied to the warps 4*a*, 4*a* constituting the warp 4 for forming the hooks and formed of a plurality of monofilaments constituting a single warp by alternately disposing right hand wound and left hand wound supply bobbins in a creel. The twistings are released to restore the warps 4*a*, 4*a* to their original posture at the time of the above-described loop cutting, thereby facilitating the rotations. As a result, openings of the plurality of hook-shaped engaging elements 2*a* standing up from the same base end portion are oriented in different directions at a necessary angle θ in a range of 0° to 90° about the base end portion as a center as shown in FIG. 5.

According to the surface fastener formed of fibers of the invention obtained in the above manner, the plurality of hook-shaped engaging elements 2*a* with their base end portions being secured and integrated by using the backing agent stand up from the same position of the foundation cloth 1 with their openings in different orientations. As a result, unlike the conventional surface fastener in which a single hook-shaped engaging element is engaged with the mating plurality of loops, plurality of hook-shaped engaging elements 2*a* are engaged with the plurality of loops at the same position, separating the loops in the invention. Moreover, because the diameter of each the engaging element 2*a* is set at such a value that the single engaging element 2*a* can exhibit satisfactory engaging strength, a total engaging rate, and thus, the engaging strength are increased. Because the diameter of the engaging element is smaller than that of the conventional engaging element formed of a single monofilament, the individual engaging element 2*a* is easily and elastically deformed in peeling of the surface fastener, thereby carrying out smooth peeling. Moreover, strange peeling noise becomes extremely low.

Because the engaging element 2 is in the hook shape, the surface of the surface fastener is less prickly to the touch. Furthermore, because each the hook-shaped engaging element 2*a* excluding the base end portion has the smaller diameter than a conventional hook-shaped engaging element, the hook-shaped engaging element 2*a* is excellent in flexibility and is extremely favorable to the touch. Especially, it is a point to be emphasized that rigidity of the base end portions of the hook-shaped engaging elements 2*a* is increased to reduce tendency of the respective hookshaped engaging elements 2*a* to fall down, and that the hook forms can be maintained in engaging the surface fasteners with each other by pushing the mating female surface fastener against the male surface fastener to carry out smooth engagements of the hooks with the loops and to further increase the engaging rate because the base end portions of the plurality of hook-shaped engaging elements 2*a* standing up from the same position of the foundation cloth 1 are secured and integrated by using the backing agent.

Figure 6:
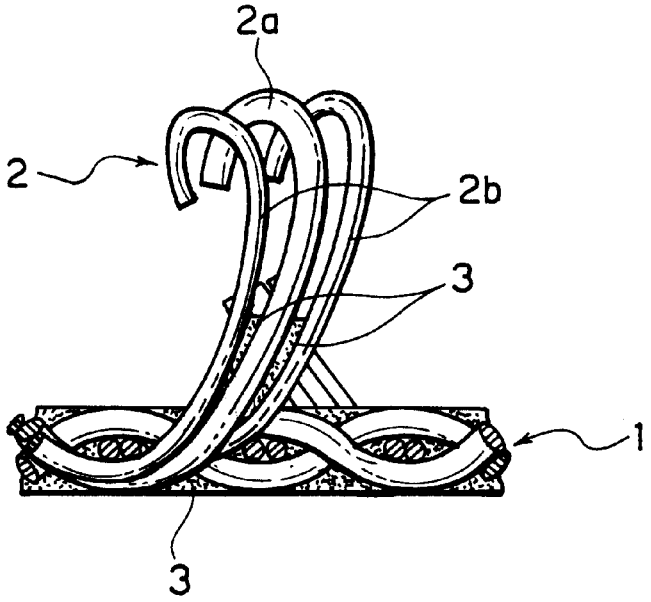
FIG. 6 is a fragmentary sectional view of a surface fastener having a plurality of hook-shaped engaging elements with different diameters.

FIG. 6 shows a second embodiment of the invention. According to this embodiment, as shown in FIG. 6, hook-shaped engaging elements formed of a plurality of monofilaments standing up from the same position of the foundation cloth 1 have different diameters. In the illustrated example, the number of the hook-shaped engaging elements 2*a,* 2*a,* and 2*b* standing up from the same position of the foundation cloth 1 is three and two of them have smaller diameters than the rest of them. By setting the diameters of the hook-shaped engaging elements 2*a* and 2*b* at different values from each other in this manner, the engaging strength of the hook with the loop mainly depends on the thick engaging element 2*b* and the engaging strength exhibited by the other hook-shaped engaging elements 2*a* with smaller diameters are added, and as a result, necessary engaging strength can be ensured. At the same time, the entire engaging face on which the hook-shaped engaging elements 2 stand becomes flexible to the touch. Furthermore, due to existence of the hook-shaped engaging elements 2*a* with the smaller diameter, generation of the strange peeling noise in peeling of the surface fastener can be further diminished.

Figure 7:
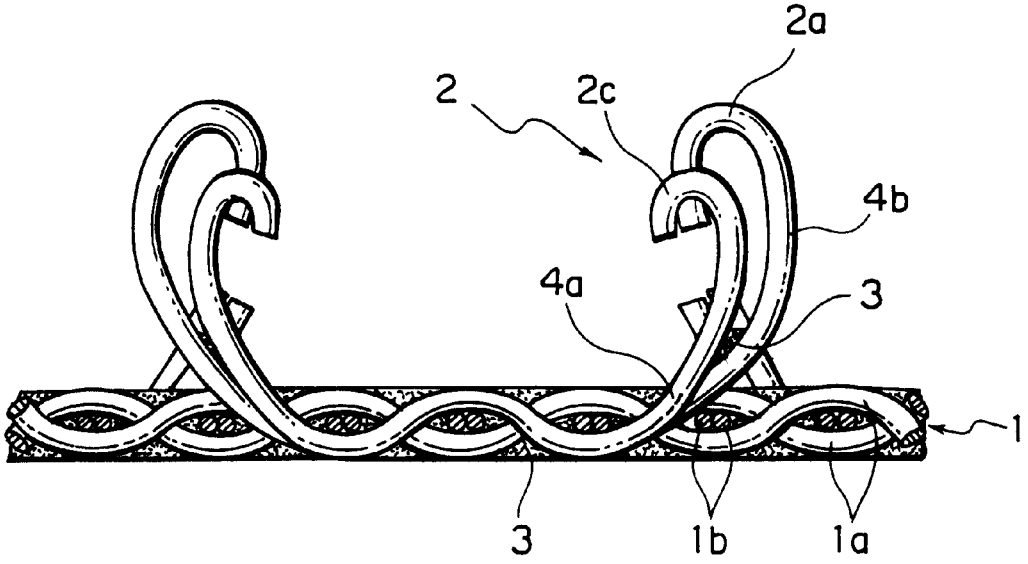
FIG. 7 is a fragmentary sectional view of a surface fastener having a plurality of hook-shaped engaging elements with different heights.

FIG. 7 shows a third embodiment of the invention. According to this embodiment, as shown in FIG. 7, hook-shaped engaging elements 2*a* and 2*c* formed of a plurality of monofilaments standing up from the same position of the foundation cloth 1 have different heights. In order to form the hooks with different heights in this manner, the plurality of (two in the example shown in FIG. 7) monofilaments 4*a,* 4*b* constituting a warp 4 for forming hooks should have different heat contraction properties. In other words, highly heat contractive material is selected as one of the plurality of monofilaments 4*a* and 4*b* and low heat contractive material is selected as the other of the monofilaments 4*a,* 4*b.* When the contraction properties are exhibited by thermal setting after weaving or in a final heat treatment or in dyeing, it is possible that the plurality of hook-shaped engaging elements standing up from the same position of the foundation cloth 1 automatically have different heights.

When the plurality of hook-shaped engaging elements 2*a,* 2*c* standing up from the same position have different heights as described above, even when the mating female surface fastener is formed of a non-woven fabric and the loops do not have uniform height and shape, the hook-shaped engaging elements 2*a,* 2*c* corresponding to the loops can be engaged with the loops. As a result, the engaging rate is further increased as compared with that of the hook-shaped engaging elements 2*a,* 2*a* with the same height and the necessary engaging force can be ensured even when the engaging elements 2*a* and 2*c* are formed of the monofilaments 4*a,* 4*b* with the smaller diameter.

Figure 8:
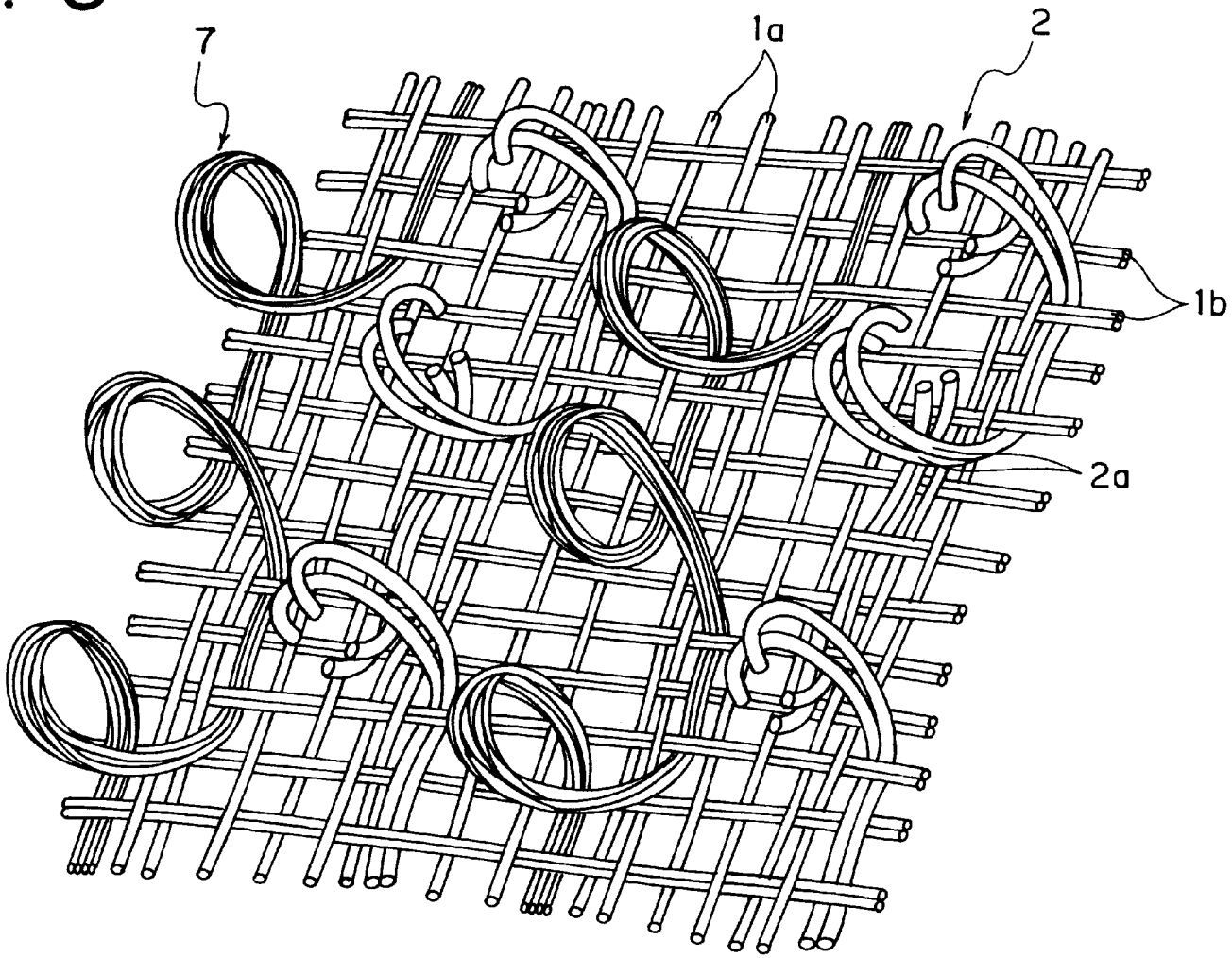
FIG. 8 is a fragmentary perspective view schematically showing a surface fastener of the invention wherein hook-shaped engaging elements and loops are mixed.

FIG. 8 shows the fourth embodiment of the invention. In this embodiment, every other hook-shaped engaging element row of the plurality of hook-shaped engaging element rows arranged in a weft direction in FIG. 1 is replaced by a loop row. In other words, rows of the hook-shaped engaging elements 2 and rows of the loops 7 as the female engaging elements are arranged alternately in the weft direction on the same surface of the same foundation cloth 1. With this structure, it is unnecessary to distinguish the female and male surface fasteners from each other, thereby facilitating control and attachment of fastener products.

The above descriptions are about the preferred embodiments of the invention and it will be understood from the above descriptions that the invention is not limited to the above embodiments. For example, although the conventional typical form is employed as the form of the hook-shaped engaging element in the above embodiments, other various forms can be also employed and the number and the diameter of the engaging elements formed of monofilaments and standing up from the same position of the foundation cloth may be determined arbitrarily in light of flexibility and engaging strength.

What is claimed:

1. A surface fastener formed of fibers, the surface fastener comprising:

a plurality of male engaging elements each having a length planted on a foundation cloth, the foundation cloth being a woven or knitted fabric or a non-woven fabric and formed of fibers, the surface fastener configured to be engaged with and disengaged from a mating surface fastener, wherein the surface fastener includes groups, each group including at least two of the male engaging elements having a diameter and base end portions extending upward from a common position on a face of the foundation cloth, wherein respective base end portions of the male engaging elements are joined by a backing agent which is applied to a rear face of the foundation cloth and penetrates through the rear face of the foundation cloth and extends to a penetration height above the foundation cloth along the base end portions between adjacent male engaging elements.

2. A surface fastener formed of fibers according to claim 1, wherein the plurality of male engaging elements are in a hook shape.

3. A surface fastener formed of fibers according to claim 2, wherein, within each group, engaging heads of the plurality of male engaging elements are oriented in different directions at an angle in a range of 0° to 90° from each other about a base end portion of the group as a center.

4. A surface fastener formed of fibers according to claim 1, wherein at least one of the male engaging elements within at least one group has a larger diameter than the rest of the engaging elements.

5. A surface fastener formed of fibers according to claim 1, wherein at least one of the male engaging elements within at least one group is higher than the rest of the male engaging elements within the at least one group.

6. A surface fastener formed of fibers according to claim 1, wherein loop-shaped female engaging elements are planted on and standing up from the face of the foundation cloth.

* * * * *